US008376022B2

(12) United States Patent
Lin

(10) Patent No.: US 8,376,022 B2
(45) Date of Patent: Feb. 19, 2013

(54) LOOP CORD TENSION DEVICE FOR WINDOW COVERINGS

(75) Inventor: Tzong-Fu Lin, Taipei (TW)

(73) Assignee: Whole Space Industries Ltd, Taipei (TW)

( * ) Notice: Subject to any disclaimer, the term of this patent is extended or adjusted under 35 U.S.C. 154(b) by 132 days.

(21) Appl. No.: 13/030,325

(22) Filed: Feb. 18, 2011

(65) Prior Publication Data

US 2012/0211180 A1 Aug. 23, 2012

(51) Int. Cl.
*A47H 1/00* (2006.01)

(52) U.S. Cl. ..... 160/321; 474/136

(58) Field of Classification Search ..... 160/321, 160/344; 474/136
See application file for complete search history.

(56) References Cited

U.S. PATENT DOCUMENTS

| | | | | |
|---|---|---|---|---|
| 120,971 | A * | 11/1871 | Hoffmeister | 160/298 |
| 1,515,372 | A * | 11/1924 | Smith | 188/69 |
| 2,234,804 | A | 3/1941 | Murray | |
| 3,447,586 | A | 6/1969 | Anderle | |
| 4,122,886 | A | 10/1978 | Marangoni | |
| 4,909,298 | A | 3/1990 | Langhart et al. | |
| 5,067,545 | A | 11/1991 | Wilkins et al. | |
| 5,465,779 | A | 11/1995 | Rozon | |
| 5,613,540 | A | 3/1997 | Jelic | |
| 5,873,400 | A | 2/1999 | Faller | |
| 6,085,824 | A * | 7/2000 | Cadorette | 160/177 V |
| 6,186,214 | B1 | 2/2001 | Ladd et al. | |
| 6,237,885 | B1 | 5/2001 | Mitchell | |
| 6,536,503 | B1 | 3/2003 | Anderson et al. | |
| 6,749,000 | B2 | 6/2004 | Bohlen | |
| 6,792,995 | B2 | 9/2004 | Judkins | |
| 6,792,999 | B2 * | 9/2004 | Cross et al. | 160/321 |
| 7,114,544 | B2 | 10/2006 | Rice | |
| 7,931,069 | B2 * | 4/2011 | Cannaverde et al. | 160/173 R |
| 2008/0251622 | A1 | 10/2008 | Randall | |
| 2011/0036517 | A1 | 2/2011 | Chen | |

FOREIGN PATENT DOCUMENTS

DE 202009016013 U1 3/2010

OTHER PUBLICATIONS

European Search Report for Application No. EP 11 17 9257 dated Feb. 17, 2012.

* cited by examiner

*Primary Examiner* — Blair M. Johnson
(74) *Attorney, Agent, or Firm* — Buchanan Ingersoll & Rooney PC

(57) ABSTRACT

A loop cord tension device assembly includes a housing, a spring member connected to the housing, a loop cord retention member connected to the housing, and a locking body connected to the spring member. The loop cord retention member has a channel sized and configured to receive a portion of a looped cord. The locking body is moveable from a locked position to an unlocked position. The portion of the loop cord received within the channel of the loop cord retention member is not rotatable when the locking body is in the locked position and the portion of the loop cord received within the channel of the loop cord retention member is rotatable when the locking body is in the unlocked position. The loop cord tension device assembly may be connected to the looped cord of a window covering and mounted to a structure to improve child safety.

13 Claims, 6 Drawing Sheets

LOOP CORD TENSION DEVICE FOR WINDOW COVERINGS

FIELD OF THE INVENTION

The present invention relates to tension devices used to provide tension to loop cords of loop cord drives used in window coverings such as Roman shades, cellular shades, or pleated shades.

BACKGROUND OF THE INVENTION

Window coverings may utilize a loop cord drive to permit a user to actuate the raising or lowering of the window covering. The looped cord of a loop cord drive often includes beads or stops on the looped cord of the loop cord drive. The cord of the looped cord may be a cord formed from intertwined elongated members, or may be a polymeric elongated member or may be defined by a chain. Typically, the elongated members of the looped cord is flexible. The looped cord typically has stops attached thereto. The stops may be beads or other types of stops connected to the looped cord. Examples of loop cord drive systems, which may also be referred to as endless cord drive systems, may be appreciated from U.S. Pat. Nos. 6,749,000, 6,536,503, and 5,465,779.

Typically, looped cords include a top end that is entrained along a drive mechanism of the loop cord drive and a bottom end that hangs freely and is positioned adjacent to window covering material of the window covering. A user may rotate the looped cord in one direction to raise the window covering and rotate the looped cord in an opposite direction to lower the window covering. The looped cord often extends from adjacent to a headrail to a relatively low position to permit users to easily grab or manipulate the looped cord. Such a size, however, also permits small children to occasionally play with the looped cord or to come in contact with the looped cord.

In some instances, a relatively long looped cord may pose a threat to an unsupervised child. Small children such as toddlers or babies may play with the cord or may become entangled within the looped cord. For instance, a low freely hanging looped cord may be accidentally positioned near a toy box or dresser on which an unsupervised child may climb. Child entanglement with a looped cord may be dangerous and can pose a strangulation risk to the child.

For several years, the art has offered tie downs for looped cords. These tie downs consist of a pulley around which the cord passes and which can be attached to a window frame. The pulley does not prevent the loop cord from moving such that the loop cord can always be used to raise or lower the blind. This type of tie down is sometimes called a cord tension device.

A second type of tie down is a hook around which the cord is tied. When the cord is secured to the hook, the cord cannot be used to lower or raise the blind.

There is a need for a tie down or cord tension device that has the properties of both the pulley type and the hook type known in the art. Such a tie down would enable the cord to move when in an unlocked position and prevent cord movement when in a locked position. Preferably, the tie down could be installed so that the cord is always locked, always unlocked, or capable of being locked or unlocked by the user.

SUMMARY OF THE INVENTION

A window covering is provided. The window covering includes a mounting device, window covering material connected to the mounting device, a drive mechanism connected to the mounting device, and a tension device. The window covering material is moveable from an extended position to a retracted position. The drive mechanism may be actuatable to drive movement of the window covering material. The drive mechanism may include a loop cord connected to a drive device such that rotation of the loop cord actuates the drive device to drive movement of the window covering material. The tension device is connected to the loop cord. The tension device includes a housing, a spring member connected to the housing, a loop cord retention member connected to the housing, and a locking body connected to the spring member. The loop cord retention member has a channel sized and configured to receive a portion of the looped cord. The locking body is moveable from a locked position to an unlocked position. The portion of the loop cord received within the channel of the loop cord retention member is not rotatable to drive movement of the window covering when the locking body is in the locked position. The portion of the loop cord received within the channel of the loop cord retention member is rotatable to drive movement of the window covering when the locking body is in the unlocked position.

The loop cord may include an elongated looped member and stops attached to the elongated looped member. The stops may be beads or members that have a width greater than a width of the elongated looped member.

In some embodiments of the window covering, the housing may include a slot and at least one of the locking body and the spring member having a hole sized and configured to be alignable with a portion of the slot of the housing when the locking body is in the unlocked position. A bottom portion of the slot may be wider than a middle portion of the slot and the hole may be alignable with the bottom portion of the slot. The housing may also include a hole formed in the housing that is positioned adjacent to the bottom portion of the slot such that the hole is in communication with the slot. The hole of the housing is aligned with the hole of the locking body or the spring member such that the locking body is held in the unlocked position when a fastener is extended through the hole formed in the housing and the hole of the locking body or the spring member.

The housing of the tension device may have a first side and a second side opposite the first side. One side of the housing may have a first slot and the other side of the housing may have a slot or other aperture that is aligned with at least a portion of the first slot. Preferably, the slot or aperture of the other side of the housing is aligned with the hole of the spring member when the locking body is in the locked position.

The spring member of the tension device may have any of a number of different structures. For instance, the spring member may be an elongated member that has a plurality of curved portions, waves, bendable portions, or coiled portions. The spring member may be composed of a polymeric material, an elastomeric material, or a metal.

In some embodiments, the mounting device may be comprised of a headrail and the drive device may include a rotatable shaft that is positioned in the headrail. The window covering material may be comprised of any of a number of suitable materials. For instance, the window covering material may be pleated material, cellular material, slats on ladders, woven wood, woven grass, non-woven fabric, woven fabric, interconnected fabric segments, or a film.

A loop cord tension device assembly for a window covering is also provided. The loop cord tension device assembly may include a housing, a spring member connected to the housing, a loop cord retention member connected to the housing, and a locking body connected to the spring member. The loop cord retention member has a channel sized and configured to receive a portion of a looped cord. The locking body is moveable from a locked position to an unlocked position. The portion of the loop cord received within the channel of the loop cord retention member is not rotatable when the locking body is in the locked position and the portion of the loop cord received within the channel of the loop cord retention member is rotatable when the locking body is in the unlocked position.

The housing may have any of a number of configurations. For instance, the housing may include a first side that is connected to a second side and the housing may enclose the spring member and at least partially enclose the locking body. As another example, the housing may have a slot and at least one of the locking body and the spring member may have a hole sized and configured to be aligned with a portion of the slot of the housing when the locking body is in the unlocked position. A bottom portion of the slot may be wider than a middle portion of the slot and the hole may be aligned with the bottom portion of the slot.

In some embodiments, the housing may be configured so that the housing is moveable relative to a fastener when the tension device is installed to move the locking body from the unlocked position to the locked position. In other embodiments, the housing may be configured to not be moveable when the device is installed.

As mentioned above with reference to the window covering, the spring member may have any of a number of configurations. Preferably, the spring member has an end portion that defines an aperture that is sized and configured to receive a projection of the housing to connect the spring member to the housing.

The locking body may be sized and configured to define an aperture sized and configured to receive a stop or bead of a looped cord when the locking body is in the locked position. Sidewalls of the locking body that at least partially define the aperture of the locking body may engage cord portions of the looped cord adjacent to the stop positioned in the aperture of the locking body when the locking body is in the locked position.

Other details, objects, and advantages of the invention will become apparent as the following description of certain present preferred embodiments thereof and certain present preferred methods of practicing the same proceeds.

BRIEF DESCRIPTION OF THE FIGURES

Present preferred embodiments of my loop cord tension device and window coverings that use embodiments of the same are shown in the accompanying drawings and certain present preferred methods of practicing the same are also illustrated therein.

DESCRIPTION OF PRESENT PREFERRED EMBODIMENTS

Figure 1:
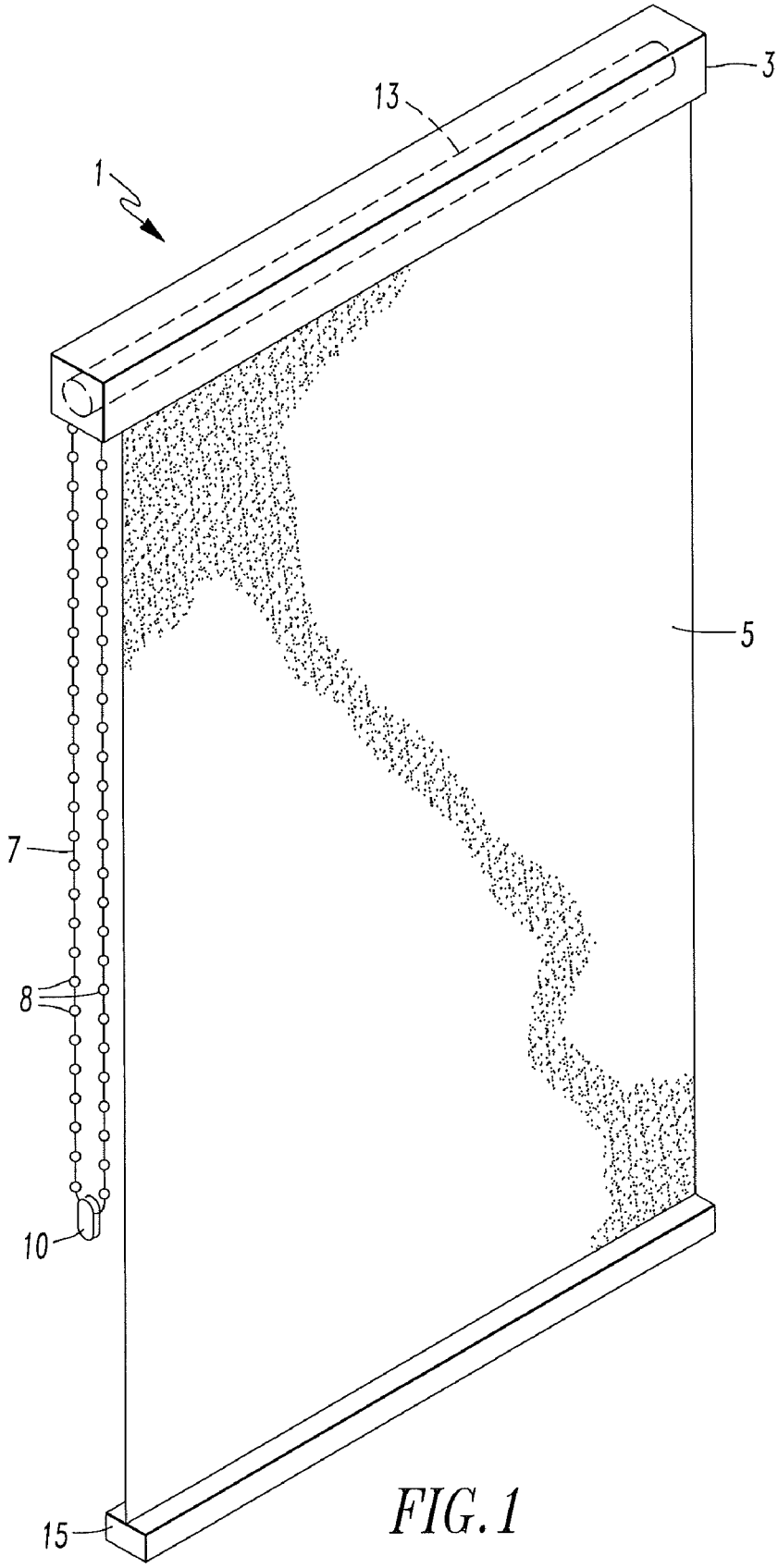
FIG. 1 is a perspective view of a first present preferred embodiment of a window covering that includes a present preferred embodiment of a loop cord tension device.
Figure 2:
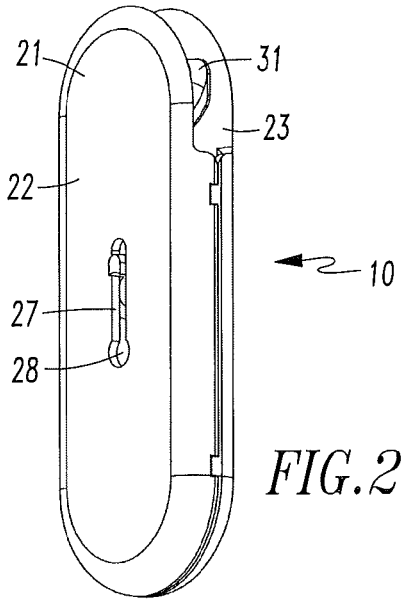
FIG. 2 is a perspective view of a first present preferred embodiment of the loop cord tension device.
Figure 3:
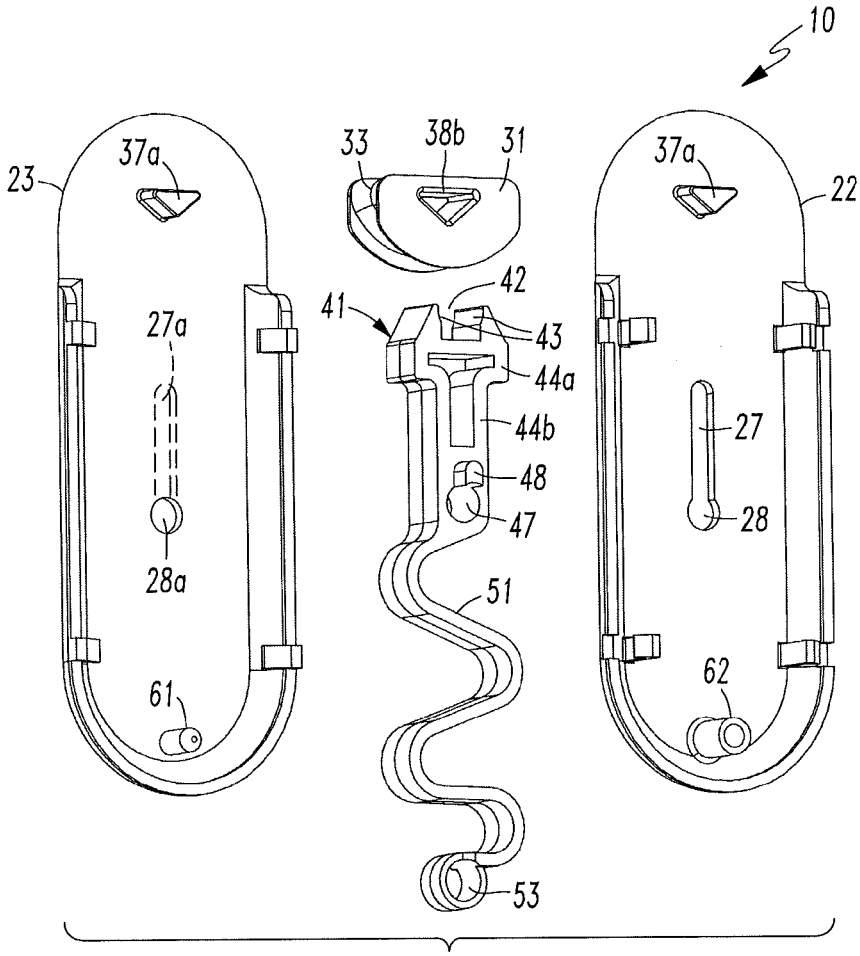
FIG. 3 is an exploded view of the first present preferred embodiment of the loop cord tension device.
Figure 4:
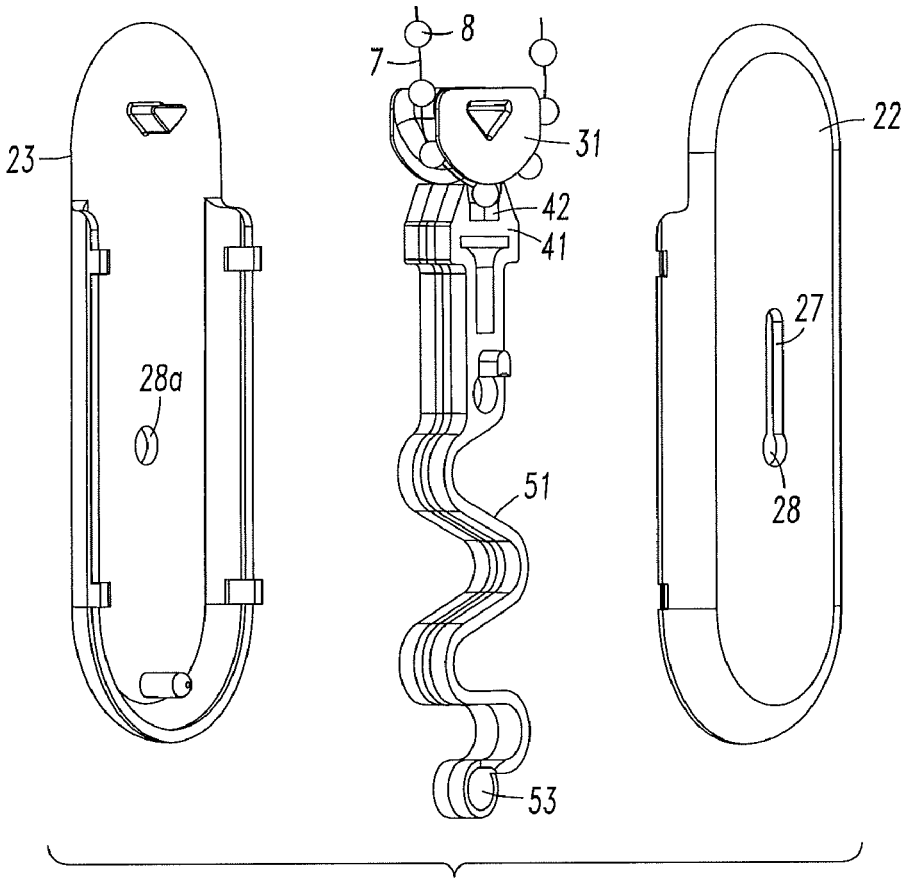
FIG. 4 is an exploded view of the first present preferred embodiment of the loop cord tension device with the locking body illustrated in a locked position. Portions of a looped cord within a channel of a loop cord retention body are shown in dotted line in FIG. 4.
Figure 5:
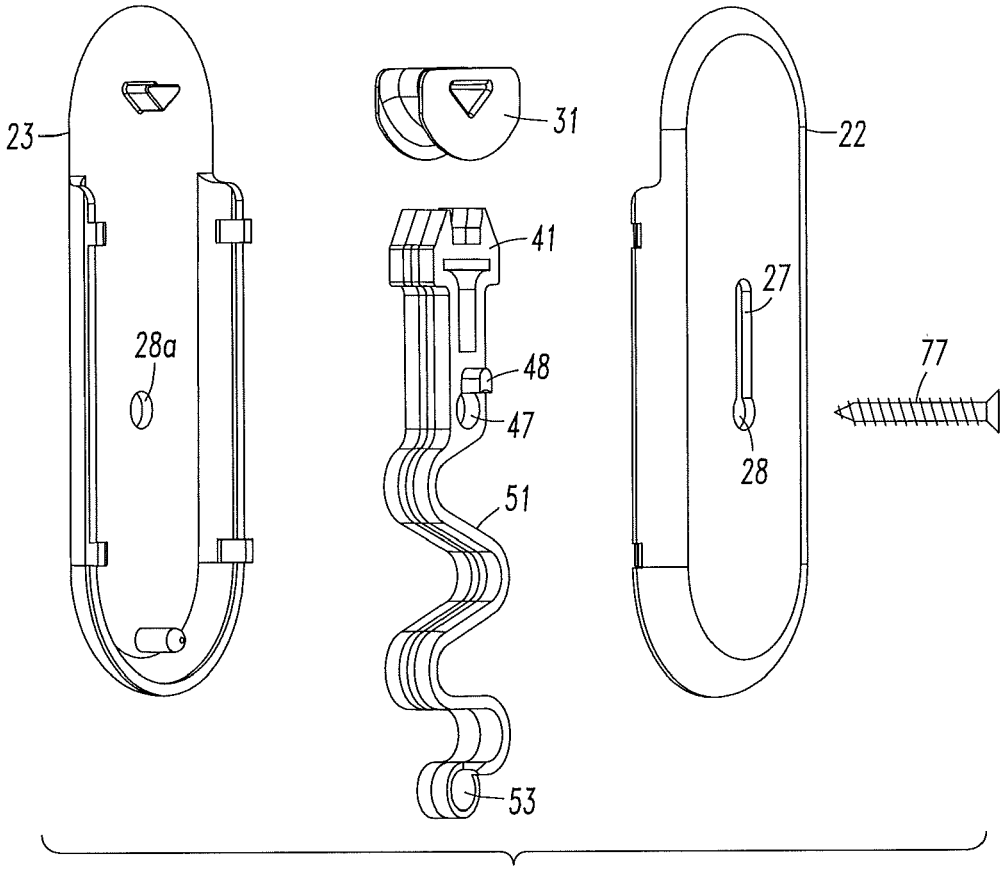
FIG. 5 is an exploded view of the first present preferred embodiment of the loop cord tension device with the locking body illustrated in an unlocked position. Portions of a looped cord received within a channel of a loop cord retention body are shown in dotted line in FIG. 5.

Referring to FIG. 1, a window covering 1 may include a mounting device 3 that is connected to window covering material 5. The mounting device 3 may include a headrail and brackets that are attached to the headrail to mount the window covering. In alternative embodiments, the mounting device may include brackets that hold a roller or shaft about which the window covering material may be wound and unwound.

A drive mechanism may be attached to the mounting device. The drive mechanism may be configured so that a drive device of the drive mechanism is actuatable via manipulation of a looped cord 7. The looped cord may have stops 8, such as beads attached to the looped cord.

The drive device may include a shaft 13. The shaft 13 may be a roller or an elongated cylinder, a polygonal shaped bar or another type of shaft. The window covering material 5 may be windable and unwindable about the shaft 13 or may be retractable and extendable using lift cords or lifting strips that wind around and unwind from the shaft 13. If the window covering material is directly windable about the shaft 13, the shaft 13 may connect the window covering material to the mounting device 3.

The shaft 13 may be connected to a device that couples the loop cord 7 to the shaft 13 such that rotation of the looped cord drives rotational movement of the shaft. Rotation of the looped cord in a particular direction may actuate a roller or shaft 13 to raise or lower the window covering material 5. For example, rotation of the looped cord in a first direction may cause the window covering material to wind about shaft 13 and rotation of the looped cord in a second direction that is opposite the first direction may cause the window covering material to extend from the shaft 13. In alternative embodiments, lift cords such as lifting tape or lifting strips of material may be wound and unwound from the shaft or spools connected to the shaft 13 to retract or extend the window covering material via rotation of the shaft 13.

In some embodiments of the window covering 1, a bottom rail 15 may be attached to the window covering material 5. The bottom rail may be structured similarly to a rod, bar, polygonally shaped elongated member or a generally rectangular structure. The bottom rail may be configured to directly engage a bottom portion of the window covering material, may be bonded, glued, or adhered to the window covering material, or may be connected to the window covering material via one or more connectors.

The window covering 1 may also include a loop cord tension device 10. The loop cord tension device 10 may be configured to receive an end portion of the looped cord 7 to lock and unlock the looped cord 7. A locked loop cord 7 may not be permitted to rotate or move sufficiently to adjust a position of the window covering material 5. An unlocked loop cord 7 may be permitted to move to adjust the position of the window covering material 5. The tension device 10 may be mounted adjacent to a window covering, such as on a wall or other structure adjacent to a window opening. One or more fasteners, such as screws, nails, or bolts, may be used to attach the tension device 10 to a wall or other structure. Preferably, the tension device is positioned such that the loop cord 7 is relatively straight and under a slight amount of tension so that the loop cord 7 is unable to be easily bent or twisted The tension device 10 may be sold along with a window covering 1 or may be sold as a separate item for installation onto a loop cord of a window covering. For instance, the tension device 10 may be sold as part of a child safety kit for window coverings. As another example, a consumer may buy a blind or shade that includes a tension device as a component of the purchased window covering. An installer may then install the tension device when the window covering is installed.

Referring to FIGS. 2-7, the tension device 10 includes a housing 21. The housing may have a slot 27 formed in a first side 22 of the housing 21. The slot 27 may include a hole 28 formed in a bottom portion of the slot 27 such that the hole is in communication with the middle portion of the slot 27. The hole 28 may be sized and configured to receive a portion of a fastener such as a screw, nail, or bolt that may be passed through holes on both sides of the housing to fasten the tension device 10 to a wall or other structure. The second side 23 of the housing 21 may have a hole 28*a* or a hole 28*a* in communication with a slot 27*a* that is illustrated in broken line in FIG. 3. The hole 28*a* is sized to receive a portion of a fastener for installation of the tension device.

A loop cord retention member 31 is connected to the housing between the sides 22 and 23. The loop cord retention member 31 has openings 38*b* that are sized to receive projections 37*a* that extend from both sides 22 and 23 and into the openings 38*b* to position the loop cord retention member 31 adjacent to an upper end of the tension device 10. The loop cord retention member 31 has a channel 33 that is sized and configured to receive an end portion of the loop cord 7 having stops 8 opposite the end of the loop cord 7 that is connected to the drive device of the drive mechanism.

A locking body 41 is positioned within the housing below the loop cord retention member 31. The locking body has side walls 43 that define an aperture 42. The aperture 42 may be a groove or slot that is sized and configured to receive a stop 8 of the loop cord portion that is within the channel 33 of the loop cord retention member 31. The locking member may have a bottom body portion 44*b* below a loop cord locking portion 44*a* that extends toward a spring member 51. The bottom body portion 44*b* may include an opening 47 and a projection 48 that extends from the body of the locking member 41. In alternative embodiments, the spring member may extend from the bottom of the loop cord locking portion 44*a* and have the hole 47 and projection 48. The hole 47 is alignable with holes 28 and 28*a* to receive a fastener 77.

The spring member 51 may include a plurality of curved portions or may define a plurality of bendable portions, compressible sections, or compressible wave sections. In alternative embodiments, it is contemplated the spring member 51 may be a metal coil spring or other type of metal spring or be a spring composed of elastomeric material or polymeric material having a different structure that provides the resiliency or compressibility necessary to permit movement of the locking member.

An end portion of the spring member may include an opening 53 that is sized and configured to receive a projection 61 that extends from the second side of the housing 23 and fits within a receptacle 62 of the first side of the housing 22 to connect the spring member 51 to the housing. The spring member 51 may be connected to the housing so that the locking member 41 is moveable from a locked position to an unlocked position. As may be appreciated from FIGS. 4-7, the locked position may be higher than the unlocked position. When the locking member 41 is in the locked position, a stop 8 may be held within the aperture 42 of the locking member to prevent movement of the loop cord 7. When the locking member 41 is in the unlocked position, the stop 8 may be outside of the aperture 42 and the loop cord may be moveable along the channel 33 of the loop cord retention member 31 such that the loop cord 7 can be rotated to adjust a position of the window covering material 5.

In some embodiments of the tension device 10, portions of the loop cord 7 adjacent to the stop 8 held within the aperture 42 may be engaged by portions of the locking member 41 as well. For instance, the locking member 41 may have prongs that define the sidewalls 43 of the aperture and may engage portions of the loop cord 7 when the locking member is in the locked position.

When the hole 47 is aligned with holes 28 and 28*a*, the spring member 51 may be retracted to position the locking member in the unlocked position. The projection 48 may extend out of slot 27 and permit an installer to push the projection downward to move the spring member 51 so that the holes 28, 47 and 28*a* are aligned sufficiently to permit a fastener 77 to be passed through these holes. The fastener 77 may then be passed through the holes 28, 47 and 28*a* to mount the tension device to a wall or other structure and keep the tension device 10 in the unlocked position so that when the tension device 10 is mounted, the locking member 41 is maintained in an unlocked position via the fastener 77. The fastener 77 is preferably a screw or a nail. Because the locking member is in an unlocked position, a user may move the looped cord 7 to adjust the position of the window covering material 5 after the tension device 10 has been mounted.

In alternative embodiments, the hole 47 may be aligned with holes 28 and 28*a* when the spring member 51 is not retracted. Consequently, the locking member 41 may be in a locked position when the tension device 10 is mounted. A user may then manipulate the loop cord 7 to rotate the loop cord 7 only after first moving the housing of the body upwards relative to the fastener to retract the spring member 51 sufficiently to move the locking member 41 to the unlocked position. Such an actuation may require the user to use one hand to move the housing 21 to compress the spring member 51 and maintain the position of the tension device so that the locking member 41 is in the unlocked position while using his or her other hand to rotate the loop cord 7 to adjust the position of the window covering material 5 of the window covering. When the window covering material has been moved to a new desired location, the user may release the housing, which permits the spring member 51 to expand to reposition the locking member in the locked position. It should be appreciated that the fastener that extends through holes 28, 47 and 28*a* may not be positioned so that it attached the housing 21 to a structure so tightly that it prevents movement of the housing 21 relative to the fastener for such alternative embodiments.

Figure 6:
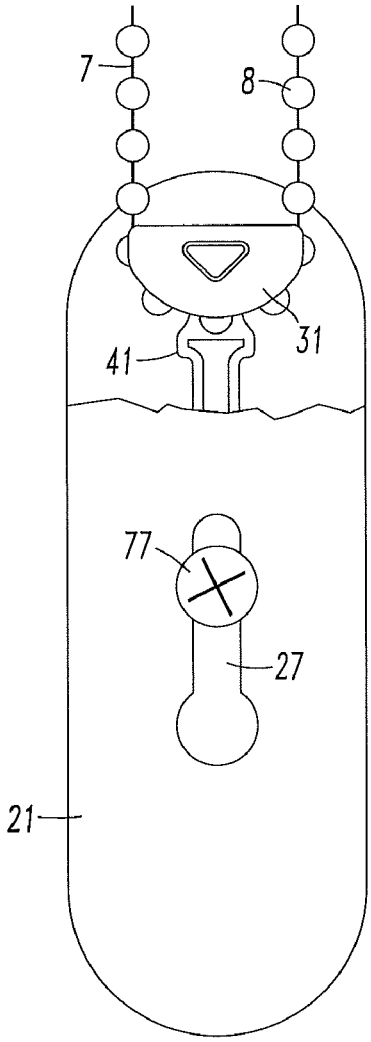
FIG. 6 is a front view of the first present preferred embodiment of the loop cord tension device with a portion of the housing cut away to illustrate the locking body in a locked position.
Figure 7:
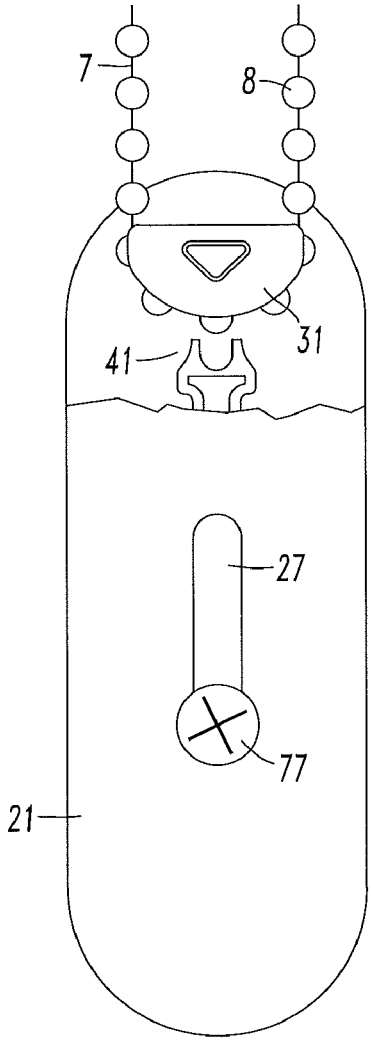
FIG. 7 is a front view of the first present preferred embodiment of the loop cord tension device with a portion of the housing cut away to illustrate the locking body in an unlocked position.

For instance, as may be appreciated from FIGS. 6-7, a fastener 77 may be positioned through the housing and a portion of the spring member 51 adjacent to an upper or middle portion of a slot in the housing 21 to install the tension device 10 to a structure. The tension device may be installed such that the housing 21 is moveable upwards and downwards. A user may slide the housing 21 upwards to compress the spring member and move the locking member from the locked position to the unlocked position to move the loop cord 7 and adjust the position of a window covering. Of course, in alternative embodiments the fastener 77 may be inserted through the housing 21 and a portion of the spring member 51 such that the housing is not moveable and the locking member is maintained in the unlocked position as shown in FIG. 7 after the tension device 10 is installed.

Window coverings that include loop cord drives may be sold that include embodiments of the tension device 10. The tension device 10 may be configured so that a user must install the tension device 10 and retain the loop cord of the loop cord drive under a slight tension so that the loop cord drive is not freely hanging for the loop cord drive to be operable. For instance, the drive mechanism of the loop cord drive may be configured such that it is only operable for adjusting a position of the window covering when the loop cord of the loop cord drive is under tension and provides a slight downward force that acts on the drive mechanism so that the drive mechanism can actuate movement of a shaft or other member used for adjusting lift cords such as strips, cords or lifting tape that may be retracted or extended to adjust the position of the window covering material.

Figure 8:
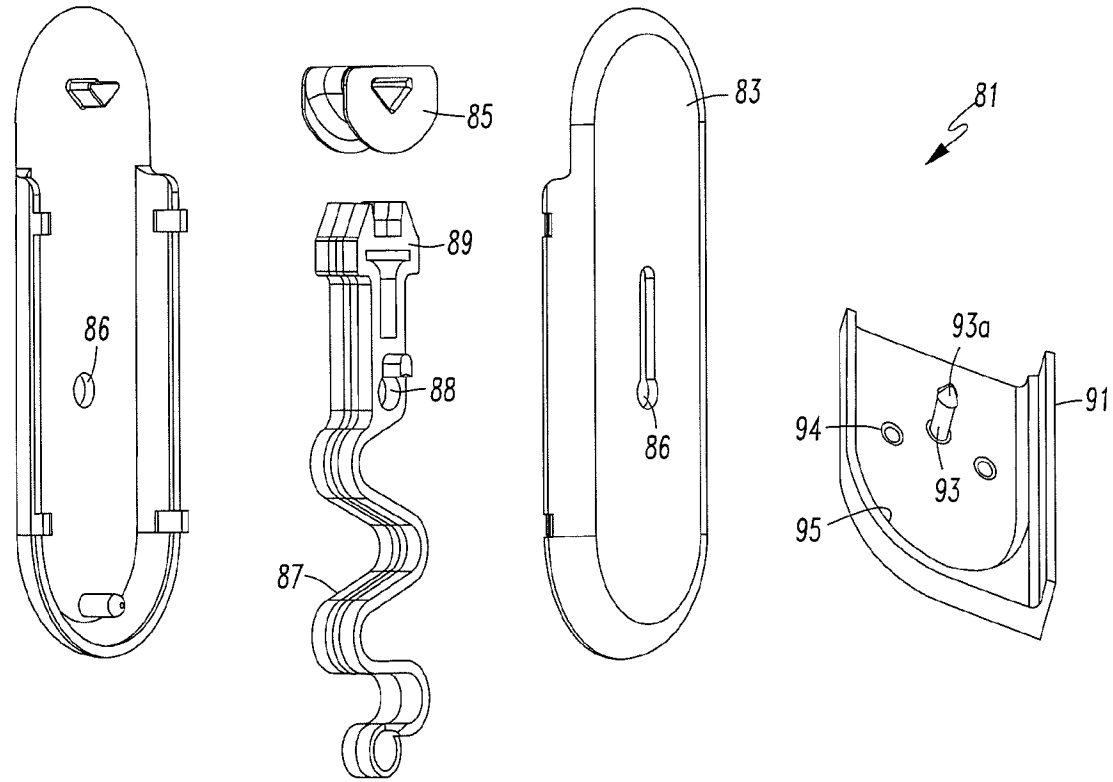
FIG. 8 is an exploded view of a second present preferred embodiment of the loop cord tension device.

In some alternative embodiments of the tension device, a base member may be utilized to help an installer better mount the tension device on a wall or other structure adjacent to a mounted window covering. For example, tension device 81, shown in FIG. 8, may include a housing 83, loop cord retention member 85, locking member 89 and spring member 87 that are similar in configuration and function to the elements of the tension device 10 discussed above. The tension device 10 may also include a base member 91. The base member 91 may include holes 94 sized and configured to permit fasteners such as screws, nails, or bolts to pass there through. The fasteners may mount the base member on a wall or other structure. The base member may also include a projection 93. The projection 93 may include a resilient head 93*a* at the distal end of the projection. The resilient head may have a diameter that is larger than the intermediate portion of the projection 93.

The housing 83 of the tension device 83 may be configured to fit within an opening or recess defined by one or more sidewalls 95 of the base member 91. The projection 93 may be sized and configured to pass through the holes 86 in opposite sides of the housing and the hole 88 in the spring member. When the projection is passed through the holes 86 and 88, the spring member may be retracted to place the locking member 89 in an unlocked position so that the loop cord of a loop cord drive may be under tension but free to be moved by a user. The housing 83 may also be affixed to the base member 91 via the projection 93 such that the housing is not moveable relative to the base member 91.

The resilient head 93*a* of the base member may be configured to deform to a smaller diameter, or smaller width, to pass through the holes 86 and 88, but resilient expand back to a larger diameter, or larger width, after being passed through the holes 86 and 88 so that the head 93*a* is able to engage and help retain the housing 93 adjacent to the base member 91. The shape of the recess or opening defined by one or more sidewalls 95 of the base member may also support the housing 83 to help keep the housing in a particular position adjacent to and attached to the base member 91.

An installer of the tension device 81 may first mount the base member 91 at a desired location on a structure adjacent to a mounted window covering. The housing 83 may then be attached to the base member by inserting the projection 93 through the holes 86 in the opposite sides of the housing and the hole 88 in the spring member. The spring member may first be retracted to position the locking member in the unlocked position so that the holes 86 and 88 are aligned such that the locking member is in an unlocked position when the housing is attached to the base member 91 via the projection 93. The head 93*a* of the projection may deform to a smaller width when a user pushes the projection 93 through the holes 86 and 88. The head 93*a* may then resiliently expand to a greater width to help retain the housing adjacent the base member 91. The housing 83 may also engage one or more sidewalls 95 when attached to the base member 91. The sidewall 95 may help support the housing 83 or help retain the housing 83 adjacent to the base member 91.

Figure 9:
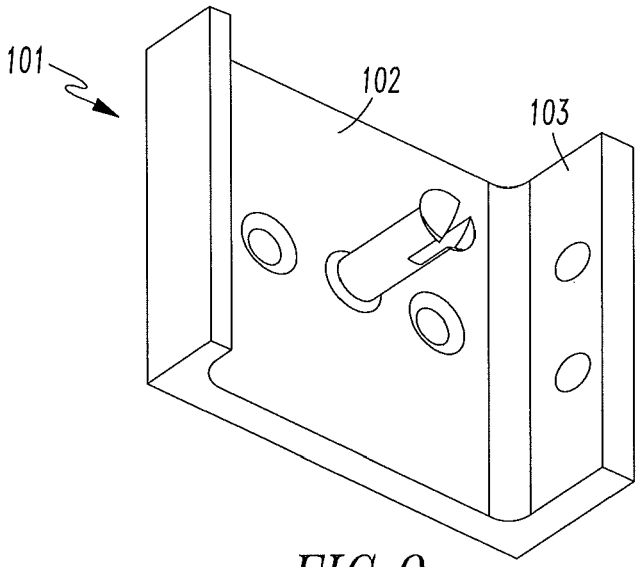
FIG. 9 is a perspective view of a present preferred embodiment of a base component that may be used in embodiments of the loop cord tension device.

The shape and size of the housing 83 and base member 91 may be changed to meet a particular design objective. For instance, an alternative embodiment of a base member 101 is shown in FIG. 9. The base member 101 may include body 102 that has holes for receiving fasteners and a sidewall 103 that has holes for receiving fasteners. The sidewall 103 and body 102 may permit an installer to mount the base member 101 to two different walls that are interconnected or may permit the base member 101 to be better affixed adjacent to a window sill via fasteners.

It should be understood that a number of variations may be made to the above discussed embodiments. For example, the window covering material 5 may be composed of any of a number of potential materials, such as cellular material, pleated material, woven grass, woven wood, woven fabric, non-woven fabric, interconnected fabric segments, or a film. As another example, the composition of the cord of the loop cord can be any of a number of compositions or structures, including an elongated polymeric filament, or a cord composed of twisted strands or fibers. As yet another example, the stops of the looped cord may be beads composed of plastic or other materials that include openings through which portions of the loop cord pass. Also, embodiments of my loop cord tension device may be sized and configured to receive a loop cord from any of a number of loop cord drive systems.

While certain present preferred embodiments of my loop cord tension device, window coverings that may use embodiments of the same, and certain embodiments of methods of practicing the same have been shown and described, it is to be distinctly understood that the invention is not limited thereto but may be otherwise variously embodied and practiced within the scope of the following claims.

I claim:

1. A window covering comprising:

a mounting device;

window covering material connected to the mounting device such that the window covering material is moveable from an extended position to a retracted position;

a drive mechanism connected to the mounting device, the drive mechanism being actuatable to drive movement of the window covering material, the drive mechanism comprising a loop cord connected to a drive device such that rotation of the loop cord actuates the drive device to drive movement of the window covering material;

a tension device connected to the loop cord, the tension device comprising:

a housing, a spring member connected to the housing;

a loop cord retention member connected to the housing, the loop cord retention member having a channel sized and configured to receive a portion of the loop cord, and a locking body connected to the spring member, the locking body moveable from a locked position to an unlocked position, the portion of the loop cord received within the channel of the loop cord retention member not being rotatable to drive movement of the window covering when the locking body is in the locked position and the portion of the loop cord received within the channel of the loop cord retention member being rotatable to drive movement of the window covering when the locking body is in the unlocked position, and a fastener member passing through the spring member and the housing for attachment to a structure such that one of (a) the locking body is maintainable in the unlocked position after the locking body is moved to the unlocked position and (b) the locking body is moveable from the locked position to the unlocked position via movement of the housing after the fastener member is attached to the structure.

2. The window covering of claim 1 wherein the housing has a slot and at least one of the locking body and the spring member having a hole sized and configured to be alignable with a portion of the slot of the housing when the locking body is in the unlocked position and wherein the fastener member passes through the housing and the spring member for attachment to the structure to maintain the locking body in the unlocked position after being moved to the unlocked position.

3. A window covering comprising:

a mounting device;

window covering material connected to the mounting device such that the window covering material is moveable from an extended position to a retracted position;

a drive mechanism connected to the mounting device, the drive mechanism being actuatable to drive movement of the window covering material, the drive mechanism comprising a loop cord connected to a drive device such that rotation of the loop cord actuates the drive device to drive movement of the window covering material;

a tension device connected to the loop cord, the tension device comprising:

a housing, a spring member connected to the housing;

a loop cord retention member connected to the housing, the loop cord retention member having a channel sized and configured to receive a portion of the loop cord, a locking body connected to the spring member, the locking body moveable from a locked position to an unlocked position, the portion of the loop cord received within the channel of the loop cord retention member not being rotatable to drive movement of the window covering material when the locking body is in the locked position and the portion of the loop cord received within the channel of the loop cord retention member being rotatable to drive movement of the window covering material when the locking body is in the unlocked position, the housing having a slot and at least one of the locking body and the spring member having a hole sized and configured to be alignable with a portion of the slot of the housing when the locking body is in the unlocked position and wherein a bottom portion of the slot is wider than a middle portion of the slot and the hole is alignable with the bottom portion of the slot.

4. The window covering of claim 3 wherein the loop cord is comprised of an elongated looped member and stops attached to the elongated looped member.

5. The window covering of claim 4 wherein the stops are beads or members that have a width greater than a width of the elongated looped member.

6. The window covering of claim 3 wherein a hole is formed in the housing and is positioned adjacent to the bottom portion of the slot such that the hole is in communication with the slot, and wherein the hole of the housing is aligned with the hole of one of the locking body and the spring member such that the locking body is held in the unlocked position when the fastener is extended through the hole formed in the housing and the hole of the one of the locking body and the spring member.

7. The window covering of claim 3 wherein the spring member is an elongated member that has a plurality of curved portions, and wherein the spring member is comprised of a polymeric material, an elastomeric material, or a metal.

8. The window covering of claim 3 wherein the mounting device is comprised of a headrail, the drive device is comprised of a rotatable shaft and the window covering material is comprised of woven wood, woven grass, non-woven fabric, woven fabric, interconnected fabric segments, or a film.

9. A window covering comprising:

a mounting device;

window covering material connected to the mounting device such that the window covering material is moveable from an extended position to a retracted position;

a drive mechanism connected to the mounting device, the drive mechanism being actuatable to drive movement of the window covering material, the drive mechanism comprising a loop cord connected to a drive device such that rotation of the loop cord actuates the drive device to drive movement of the window covering material;

a tension device connected to the loop cord, the tension device comprising:

a housing, a spring member connected to the housing;

a loop cord retention member connected to the housing, the loop cord retention member having a channel sized and configured to receive a portion of the loop cord, a locking body connected to the spring member, the locking body moveable from a locked position to an unlocked position, the portion of the loop cord received within the channel of the loop cord retention member not being rotatable to drive movement of the window covering material when the locking body is in the locked position and the portion of the loop cord received within the channel of the loop cord retention member being rotatable to drive movement of the window covering material when the locking body is in the unlocked position, wherein the housing has a slot and at least one of the locking body and the spring member having a hole sized and configured to be alignable with a portion of the slot of the housing when the locking body is in the unlocked position and the housing has a first side and a second side opposite the first side and the slot is a first slot that is formed in a first side of the housing and wherein the housing also has an aperture formed in the second side of the housing such that the aperture is aligned with at least a portion of the first slot.

10. The window covering of claim 9 wherein the aperture of the second side of the housing is aligned with the hole of the spring member when the locking body is in the locked position.

11. A loop cord tension device assembly for a window covering comprising:

a housing;

a spring member connected to the housing;

a loop cord retention member connected to the housing, the loop cord retention member having a channel sized and configured to receive a portion of a loop cord, and a locking body connected to the spring member, the locking body moveable from a locked position to an unlocked position, the portion of the loop cord received within the channel of the loop cord retention member not being moveable when the locking body is in the locked position and the portion of the loop cord received within the channel of the loop cord retention member being moveable when the locking body is in the unlocked position; and a fastener member passing through the spring member and the housing for attachment to a structure such that one of (a) the locking body is maintainable in the unlocked position after the locking body is moved to the unlocked position and (b) the locking body is moveable from the locked position to the unlocked position via movement of the housing after the fastener member is attached to the structure.

12. The loop cord tension device assembly of claim 11 wherein the housing has a slot and at least one of the locking body and the spring member having a hole that is aligned with a portion of the slot of the housing to receive the fastener member when the locking body is in the unlocked position.

13. A loop cord tension device assembly for a window covering comprising:

a housing;

a spring member connected to the housing;

a loop cord retention member connected to the housing, the loop cord retention member having a channel sized and configured to receive a portion of a loop cord;

a locking body connected to the spring member, the locking body moveable from a locked position to an unlocked position, the portion of the loop cord received within the channel of the loop cord retention member not being moveable when the locking body is in the locked position and the portion of the loop cord received within the channel of the loop cord retention member being moveable when the locking body is in the unlocked position; and wherein the housing has a first side and a second side opposite the first side, the first side having a hole and the second side having a hole and wherein the spring member has a hole, and wherein the loop cord tension device assembly further comprises a base member having a projection, the projection sized and configured to extend from the base member and pass through the hole in the first side of the housing, the hole in the spring member, and the hole in the second side of the housing, the second side of the housing being opposite the first side of the housing.

* * * * *